United States Patent [19]

Czajkowski et al.

[11] 3,981,239

[45] Sept. 21, 1976

[54] FLUIDIC LINK MASTER/SLAVE FUZE SYSTEM

[75] Inventors: Norman Czajkowski, Chevy Chase; John H. S. McMann, Highland, both of Md.

[73] Assignee: The United States of America as represented by the Secretary of the Navy, Washington, D.C.

[22] Filed: Sept. 4, 1975

[21] Appl. No.: 610,468

[52] U.S. Cl. ..... 102/7.2; 102/76 P; 102/81

[51] Int. Cl.[2] ..... F42B 25/16; F42C 15/32

[58] Field of Search ..... 102/7.2, 69, 81, 76 P, 102/70 B, 70 R, 77

[56] References Cited

UNITED STATES PATENTS

| | | | |
|---|---|---|---|
| 2,737,890 | 3/1956 | Brode | 102/81 X |
| 3,015,270 | 1/1962 | Domingos et al. | 102/81 X |
| 3,362,333 | 1/1968 | Czajkowski et al. | 102/81 |
| 3,532,057 | 10/1970 | Aubrey | 102/81 |
| 3,583,321 | 6/1971 | Anderson et al. | 102/81 |
| 3,604,357 | 9/1971 | Duncan | 102/81 |
| 3,646,889 | 3/1972 | Davis | 102/7.2 X |

*Primary Examiner*—David H. Brown
*Attorney, Agent, or Firm*—R. S. Sciascia; A. L. Branning; F. K. Yee

[57] ABSTRACT

A fuze system for cluster weapons comprises a dispenser fuze signal generator, low complexity bomblet fuze signal receivers and a fluidic signal link. The dispenser fuze generates a pneumatic enabling and arming signal to the bomblet fuzes and opens the dispenser. Deformable signal processing diaphragms and detents enable the bomblet fuzes and arm the bomblets upon dispenser opening.

15 Claims, 6 Drawing Figures

FLUIDIC LINK MASTER/SLAVE FUZE SYSTEM

BACKGROUND OF THE INVENTION

This invention relates to a fuze system. More particularly, it relates to a master-slave type fuze system having a unique fluidic communication link.

Cluster weapons, while proving highly effective, cost considerably more than conventional bombs. This cost is primarily due to the large number of bomblets in a cluster weapon and the complexity of each bomblet fuze. Cost reduction for the bomblet fuzes has reached a point at which further significant reduction appears unlikely. Therefore, to increase the cost effectiveness of cluster weapons, a fundamental change in system concept must be made.

One such concept change is to decrease the complexity of each bomblet fuze by reducing the number of functions it must perform while maintaining weapon safety and effectiveness. In arming cluster weapons, the dispenser fuze senses the environment, discriminates between proper and improper velocity, and opens the dispenser. Then each bomblet fuze senses the environment, discriminates between proper and improper velocity, and enables and arms the bomblet. Each bomblet fuze duplicates the enviromental sensing and velocity discrimination functions of the dispenser fuze, adding needless complexity and cost to each bomblet fuze.

The function that can most logically be removed from the bomblet fuze is enviromental sensing. Since this function must be done by dispenser fuze, communicating the enabling and arming information from the dispenser fuze to the bomblet fuzes is more economical than having each bomblet fuze duplicate the dispenser fuze's enviromental sensing function. This is the master-slave fuzing concept, the master being the dispenser fuze and the slave being the bomblet fuze. The communication link joining the master and slave fuzes must, of course, be reliable, quick-responding, and of simple design for maximum economy. A properly-designed fluidic link would satisfy these requirements since air is readily available within the dispenser and completely surrounds the bomblets.

The optimum signal generator controlled by the dispenser fuze would produce a pressure signal that would be unique, cause the receiver to function and cause no damage to the bomblets or dispenser. More exactly, the pressure signal should raise the pressure within the dispenser from 0 psig to 30 or 40 psig within approximately 0.5 second and should maintain that pressure until the dispenser opens no more than 1.0 second later. The signal generator should minimize any overpressure pulse that could damage either the bomblets or dispenser. Also any temperature extreme generated should not be so great as to cause a bomblet fuze functional or safety failure. Finally, the signal reception time lag between front and rear bomblets should be minimized.

The features recognized as desireable for the bomblet fuze signal receiver are a unique pressure threshold, a positive locking enabling function, no stored energy, and a delayed arming feature. Delaying arming is desirable to prevent bomblet detonation due to interbomblet collision.

SUMMARy OF THE INVENTION

Accordingly, it is an object of this invention to provide an improved fuze system for cluster type weapons.

Another object of the invention is to provide an improved fuze system of the master-slave type for cluster weapons.

Another object of the invention is to provide an improved fuze system of simple design, greater reliability and reduced cost.

Yet another object of the invention is to provide an improved fuze system which avoids duplication of functions between the master fuze and slave fuzes.

Still another object of the invention is the provision of an improved fuze system having a master fuze producing a novel and unique fluidic fuze enable and arming signal.

A further object of the invention is the provision of an improved fuze system having a slave fuze with a novel and unique bomblet fuze enable and arming mechanism.

A still further object of the invention is to provide an improved fuze system having a unique fluidic link between the master fuze and slave fuzes.

These and other objects are attained in a fuze system for cluster weapons comprising a master fuze on the dispenser which produces a fluidic signal to enable and arm the bomblet fuzes. Each bomblet fuze comprises a deformable diaphragm signal processor which enables the bomblet upon a predetermined pressure environment within the dispenser and arms the bomblet upon dispenser opening and subsequent pressure drop.

BRIEF DESCRIPTION OF THE DRAWINGS

A more complete understanding of the invention and a fuller appreciation of the many attendent advantages thereof will be readily derived by reference to the following detailed description when considered in connection with the accompanying drawings wherein.

DESCRIPTION OF THE PREFERRED EMBODIMENTS

Figure 1:
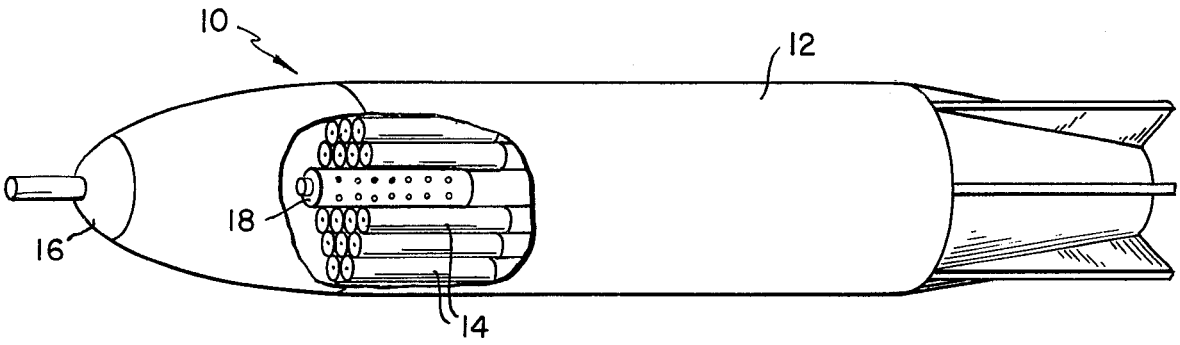
FIG. 1 illustrates the master-slave fuze system of the present invention in a cluster weapon.

Referring now to the drawings wherein like reference characters designate identical or corresponding parts throughout the several views and more particularly to FIG. 1 thereof, a cluster weapon is shown generally at 10 and includes a canister or dispenser 12 housing a plurality of bomblets 14. A dispenser fuze 16 controls the activation of the signal generator 18 and the opening of the dispenser to release the bomblets. Any of a number of environment-sensing, velocity-discriminating fuzes known in the art may be employed to as the dispenser fuze 16.

Figure 2:
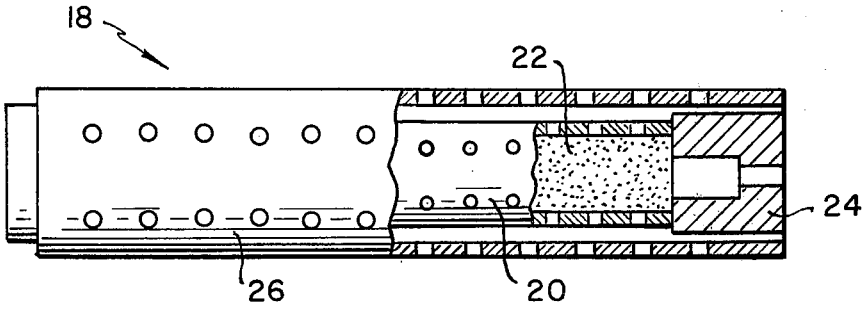
FIG. 2 shows an embodiment of the signal generator.
Figure 3A:
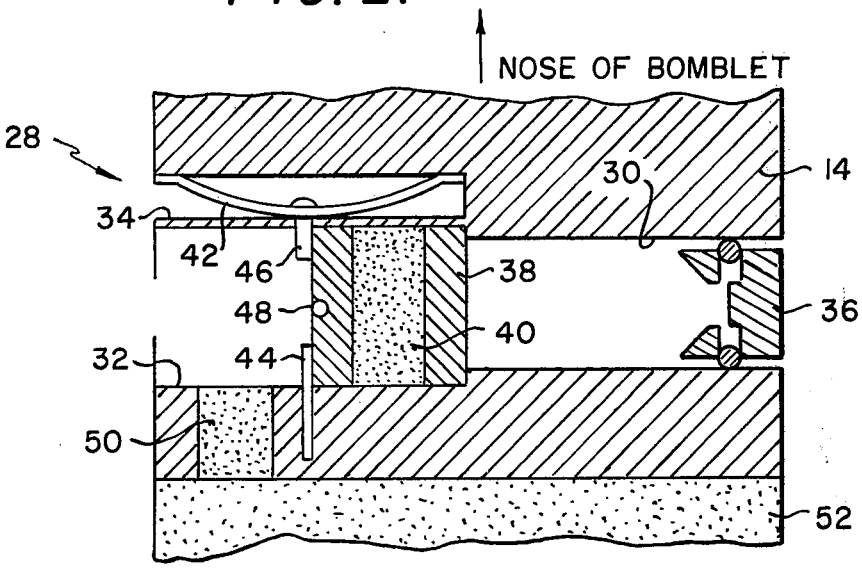
FIGS. 3*a* and 3*b* show one embodiment of the slave fuze, in the safe and enabled position, respectively.
Figure 3B:
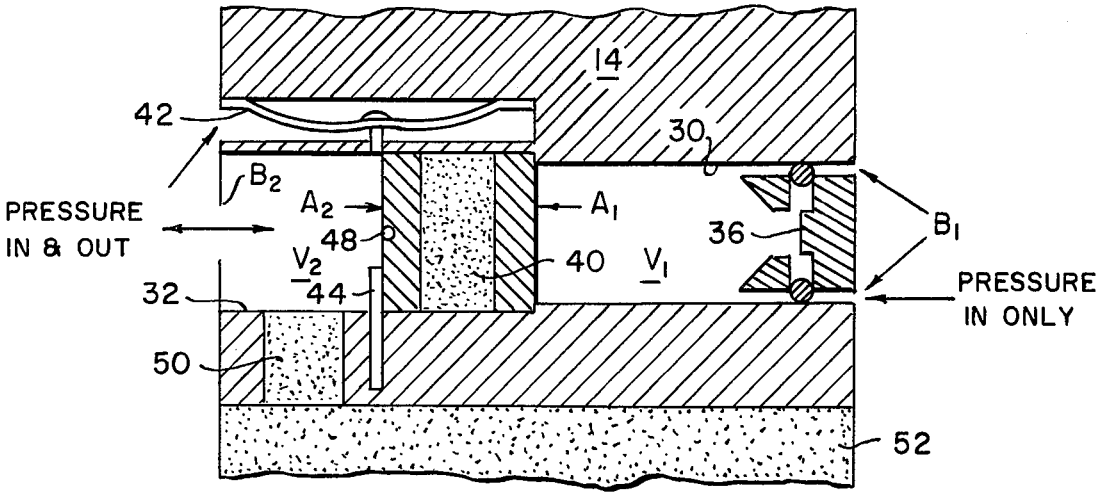

Shown in FIG. 2 is one example of a suitable signal generator 18 which is activated by the dispenser fuze 16 to produce a pressure signal which will initiate the arming process of the individual bomblet fuzes. A perforated inner tube 20 contains a charge of a suitable gas generating composition 22. An electroresponsive initiator 24 is positioned adjacent to and in contact with the composition 22 to initiate burning thereof. Surrounding the tube 20 and initiator 24 is a perforated shield tube 26 to minimize bomblet damage from the burning of the gas generating composition. The signal generator is appropriately supported in the midst of the bomblets 14 such that the pressure pulse it produces will be sensed by the individual bomblet fuzes 28. As an example of a feasible signal generator, 190 grams of smokeless powder packaged in the configuration of FIG. 2 pressurized a test dispenser to 35 psig. in approximately 0.7 second with an overpressure of only 2 psig. and no time lag between the front and rear of the dispenser.

One embodiment of the bomblet fuze 28 is illustrated in FIGS. *3a* and *3b*, showing the pressure signal receiver of the present invention. The body of the bomblet 14 is provided with bores 30 and 32, both extending radially inward from the bomblet surface. The diameter of bore 30 is smaller than that of bore 32. Adjacent to the large-diameter bore 32 is another bore 34, also extending radially inward from the bomblet surface. Positioned within the opening of bore 30 and exposed to the environment surrounding the bomblet 14 is an O-ring check valve 36, shown schematically in FIG. *3a*, which will only permit the flow of gas into the bore 30. An example of this type of check valve is described in the National Aeronautics and Space Administration Invention Report No. 30-33, "O-Ring Check Valve", prepared by the Jet Propulsion Laboratory.

Slidably positioned within the bore 32 is bomblet fuze arming slider 38 having therein a central throughbore containing an explosive primer 40. Slider 38 is held in the out-of-line, safe position of FIG. *3a* by the diaphragm 42 and the shear wire 44. In this position, slider 38 abuts, on the right side, against the shoulder formed by the different-size diameters of bores 30 and 32. The diaphragm 42, positioned within the bore 34, supports a pin 46 which extends through the side of bore 34 into the bore 32 to restrain the slider in the safe position as shown. Diaphragm 42, a bellows of a single convolution, is of a material which will maintain the arcuate shape of FIG. *3a* until a threshold force is applied, causing it to deform permanently into the deflected shape shown in FIG. *3b*. In the deformed position of diaphragm 42, the pin 46 is withdrawn, removing one restraint upon the slider 38. A thin sheet of soft metal, more commonly known as a "dead soft" metal would be suitable for the diaphragm 42.

To further enhance the safety of the bomblet fuze 14, another slider restraint may be incorporated, as shown in FIGS. *3a* and *3b*. A shear wire 44 extends from a hole in the side of bore 32 and restrains the slider 38 in its safe position. Wire 44 is designed to shear at a predetermined force produced by the pressure differential upon the surfaces $A_1$ and $A_2$ of the slider 38, as will be considered more fully hereinbelow. Use of the shear wire 44 would provide pressure threshold discrimination in addition to the metal diaphragm's 42 discrimination function. The design could be made to function at any desired working pressure by choosing the correct diaphragm and shear wire thickness.

An explosive lead 50 is positioned in a side bore, one end in contact with the slider 38 when the slider is in its armed position, and the other end in contact with the secondary explosive charge 52 within the bomblet.

Operation of the bomblet fuze 28 may be seen by referring to FIGS. *3a* and *3b*. When the proper pressure signal reaches the bomblet fuze signal receiver, two functions occur. Since the bore 34 is exposed to the pressure signal, the diaphragm 42 deforms (FIG. *3b*) withdrawing the pin 46 and placing the slider 38 in the enabled condition. Simultaneously, the charge volume in bores 30 and 32 (volumes $V_1$ and $V_2$, respectively) are pressurized by flow through O-ring check valve 36 in bore 30 and the orifice $B_2$ of bore 32. During this charging, a force balance is maintained to hold the slider 38 in the out-of-line position since volume $V_1$ is greater than the volume $V_2$, the area $A_2$ (the surface of slider 38 exposed to the pressure signal in bore 32) is greater than the area $A_1$ (exposed slider area in bore 30), and the flow rate through $B_2$ (the orifice of bore 32) is greater than the flow rate through $B_1$ (the opening of check valve 36). The signal receiver in the fuze 28 is now charged with pneumatic energy, and the arming slider 38 is in the enabled condition, being thusly restrained by the force differential and the shear wire 44.

As the dispenser 12 opens, the removal of the high pressure holding the slider allows the slider to be forced to its armed position by the pneumatic charge, shearing the wire 44 and aligning the explosive primer 40 with the explosive lead 50. Since the one-way check valve 36 prevents pressure relief in bore 30 upon dispenser opening, whereas pressure within bore 32 is relieved through the orifice $B_2$, the resultant force urges the slider to the left in FIGS. *3a* and *3b*, shearing the wire 44 in the process. The slider will be slightly delayed by the flow through orifice $B_2$, and the detent 48 will hold it in the armed position. Detent 48, shown schematically in FIGS. *3a* and *3b*, may be of the spring-biased type shown in FIGS. *4a* and *4b* and be housed in a hole in the bomblet 14.

An alternative embodiment of the bomblet fuze signal receiver 28' is illustrated in FIGS. *4a* and *4b*. The body of the bomblet 14 has extending radially inward from the surface thereof bores 30 and 32, the diameter of bore 32 being greater than that of bore 30. Adjacent to the bore 32 is another bore 34 to receive a diaphragm 42 which supports a pin 46, the diaphragm and the pin functioning similarly as in the embodiment of FIGS. *3a* and *3b*.

Slidably positioned within the bore 32 is the arming slider 38' having an explosive primer 40 positioned within a central throughbore and an elongated neck portion 39 extending into the bore 30 along the axis thereof. A spring 53 is positioned around the neck portion 39, one end of the spring abutting a surface of the slider 38' and the other end abutting a piston 54 which is slidably received within the bore 30. As shown, the piston 54 may be of a hollow, cylindrical shape, the head thereof being adjacent to the orifice leading into the bore 30 and the inner diameter being suitably sized to accommodate the spring 53 and the neck portion 39 (FIG. *4b*).

In a hole 56 perpendicular to the bore 30 is a spring-biased detent 48. In the safe position of the arming slider 38' of FIG. *4a*, with the diaphragm pin 46 holding the slider in abutment against the shoulder formed by the different-diameter bores 30 and 32, spring 53 is uncompressed and the sidewall of piston 54 prevents the detent 48 from protruding into the bore 30. The explosive primer 40 is out of alignment with the explosive lead 50.

Figure 4A:
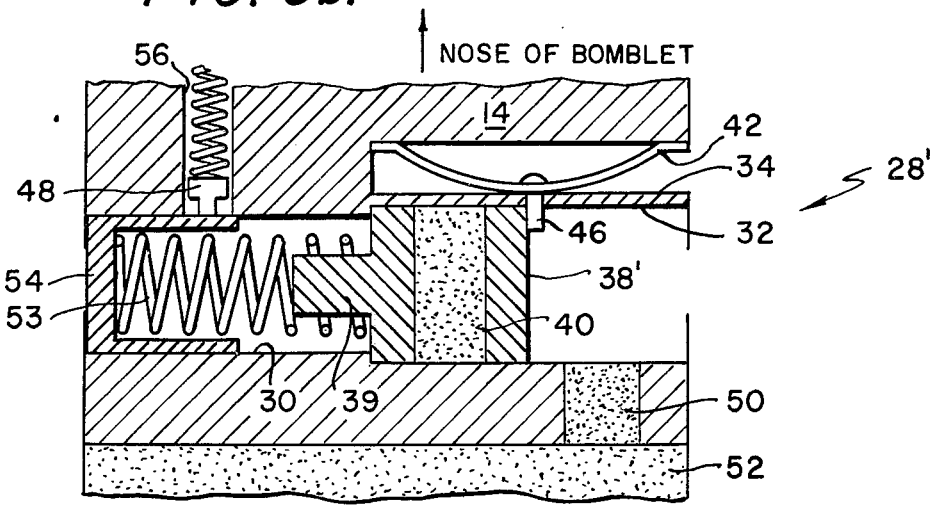
FIGS. 4*a* and 4*b* show an alternative embodiment of the slave fuze, in the safe and enabled position, respectively.
Figure 4B:
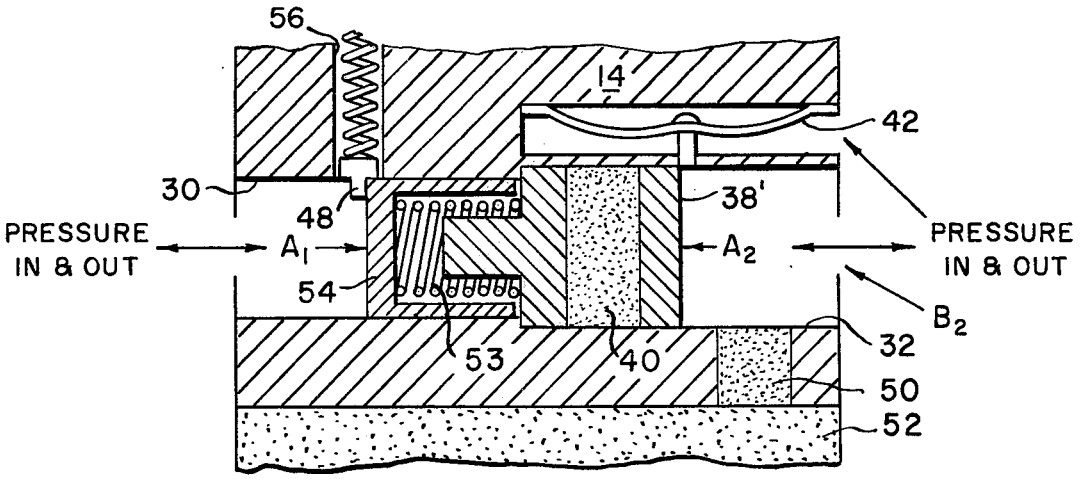

When a pressure signal of the proper magnitude reaches the bomblet fuze signal receiver 28' two functions simultaneously occur. Diaphragm 42 deforms in the fashion aforesaid relative to FIGS. *3a* and *3b*, withdrawing the pin 46 and placing the arming slider 38' in the enabled condition. Pressure entering bore 30 forces the piston 54 to the right in FIGS. *4a* and *4b*, compressing the spring 53. The spring, like the diaphragm, is designed to compress fully only in the presence of the proper pressure. Since the slider area $A_2$ in the bore 32 is greater than the area $A_1$ of the piston 54 in bore 30, the force balance on the slider 38' will hold the slider in the enabled position of FIG. 4*b* after pressurization.

When the spring 53 has been fully compressed the detent 48 protrudes into bore 30, abutting the head of piston 54 to lock it in place. The shoulder on the detent pin prevents its complete entry into the bore 30. The bomblet fuze signal receiver is now enabled, charged with mechanical energy and ready for fuze arming.

Removal of the high pressure holding the slider by the opening of the dispenser 12 allows the slider 38' to be forced by the spring 53 to its armed position, aligning the explosive primer 40 with the explosive lead 50. The slider motion will be slightly delayed by the flow through the orifice $B_2$, the orifice leading into bore 32.

The operation of the master-slave fuze system is now evident from the foregoing description. Briefly, the dispenser or master fuze 16 senses the environment, discriminates between proper and improper velocity and then initiates the signal generator 18. Activation of the generator 18 produces a pressure signal inside the dispenser within a short time interval, e.g., a pressure of approximately 40 psig. within 0.6 second after initiation. When the pressure signal reaches the bomblet fuze signal receiver 28, the aforesaid functions occur, depending upon whether the embodiment of FIGS. 3*a* and 3*b* or FIGS. 4*a* and 4*b* is employed. In either case, the signal receiver is charged with energy and the arming slider is in the enabled position.

The dispenser fuze 16 now opens the dispenser 12, approximately one second after the signal generator 18 has been initiated. Opening of the dispenser removes the high pressure holding the arming slider 38 or 38', allowing the slider to be forced to its armed position to align the explosive primer 40 and the explosive lead 50. Detent 48 will hold the slider in the armed position. The explosive 52 in bomblet 14 is now ready to be appropriately initiated by the bomblet fuze.

The bomblet fuze signal receivers 28 shown in FIGS. 3 and 4 are intended only to illustrate the operation of the receivers. The basic components may be arranged and oriented other than as shown, depending upon packaging requirements. Such other arrangements and embodiments are fully comprehended within the scope of the present disclosure.

Obviously numerous modifications and variations of the present invention are possible in light of the above teachings. For example, an alternative to the gas generating propellant signal generator would be a compressed air cyclinder for a signal generator. If inter-bomblet collisions cause bomblet detonation, and if this detonation causes a system safety problem, a viscous fluid or another suitable delay mechanism may be added to the volume of bore 32.

What is claimed as new and desired to be secured by Letters Patent of the United States is:

1. A pressure responsive fuze comprising:

a first pressure chamber in fluid communication with the ambient environment;

a second pressure chamber in fluid communication with said first chamber and with the ambient environment;

an explosive firing train having a component adjacent to said second chamber;

a fuze arming element slidably positioned in said second chamber and supporting a second component of said explosive firing train, said arming element responsive to pressure differentials between said first and said second pressure chambers to vary the position of said second component; and restraining means to hold said arming element in a safe position with the explosive train components out of line, said restraining means being displaced upon a pressure increase in said pressure chambers to permit said arming element to be displaced from said safe position to the armed position to align the explosive train components upon a pressure decrease in said second chamber.

2. The fuze of claim 1 wherein said restraining means include a diaphragm deformable at a predetermined pressure and a pin supported by said diaphragm, said pin abutting said arming element to restrain said element in said safe position.

3. The fuze of claim 2 further comprising a third pressure chamber in fluid communication with the ambient environment to house said deformable diaphragm.

4. The fuze of claim 3 wherein said arming element comprises a sliding block having a bore containing said second component of said explosive firing train, said block movable within said second pressure chamber from said safe position adjacent one end of said second chamber to the armed position adjacent the other end of said chamber.

5. The fuze of claim 4 further comprising:

a piston in said first pressure chamber, said piston movable in response to a pressure increase in said first chamber;

a spring between said piston and said arming element; and biased holding means cooperating with said piston to hold said spring compressed, said diaphragm being deformed and said spring being compressed by an increase in pressure in said pressure chambers, said biased holding means preventing extension of said spring to place said arming element in an enabled condition and said arming element being forced by said spring into said armed position upon a release of pressure in said second chamber.

6. The fuze of claim 4 further comprising flow control means in said first pressure chamber permitting fluid flow only into said first pressure chamber.

7. The fuze of claim 6 wherein said flow control means comprises a one way valve permitting fluid flow only into said first pressure chamber.

8. The fuze of claim 7 wherein said restraining means further includes a shear wire abutting said arming element to restrain said element in said safe position, said wire being sheared at a predetermined pressure differential on said arming element.

9. A fuzing system for cluster munitions having a dispenser and a plurality of bomblets in the dispenser, each bomblet having a fuze comprising:

a dispenser fuze to control the opening of the dispenser and the arming of the bomblets;

a signal generator controlled by said dispenser fuze to produce a fluidic signal to control bomblet fuze arming; and a signal receiver in the fuze of each of the plurality of bomblets, said receiver placing the bomblet fuze in the enabled condition upon receipt of the signal from said signal generator and arming the bomblet fuze upon dispenser opening and pressure release.

10. The fuzing system of claim 9 wherein said signal generator comprises a gas generator for rapidly producing a high pressure signal.

11. The fuzing system of claim 10 wherein said bomblet fuze signal receiver comprises:

a first and a second pressure chamber in fluid communication with each other and with the ambient environment within the dispenser;

an explosive firing train having a component adjacent to said second chamber;

a fuze arming element in said second chamber supporting a second component of said explosive firing train; and restraining means to hold said arming element in a safe position adjacent one end of said second chamber with the explosive train components out of line, said restraining means being displaced by the pressure signal from said signal generator to place said arming element in the enabled condition and said arming element moving to the armed position adjacent the other end of said second chamber to align said explosive train upon dispenser opening and pressure release.

12. The fuzing system of claim 11 wherein said bomblet fuze signal receiver further comprises:

a third pressure chamber in fluid communication with the dispenser;

said restraining means including a diaphragm permanently deformable at a predetermined pressure and positioned within said third chamber, and a pin attached to said diaphragm and extending into said second chamber to restrain said arming element in said safe position.

13. The fuzing system of claim 12 further comprising:

a piston in said first chamber movable in response to the pressure signal from said signal generator;

a spring between said piston and said arming element; and biased holding means cooperating with said piston to hold said spring compressed, wherein said diaphragm is permanently deformed by the pressure signal and said spring is compressed to place said arming element in an enabled condition, said arming element being forced by said spring into said armed position by pressure release upon dispenser opening.

14. The fuzing system of claim 12 further comprising a one way valve in said first pressure chamber to permit fluid flow only into said first chamber.

15. The fuzing system of claim 13 wherein said restraining means further includes a shear wire abutting said arming element to restrain said element in said safe position, said wire being sheared at a predetermined pressure differential on said element.

* * * * *